US011420347B2

(12) United States Patent
Sakon et al.

(10) Patent No.: US 11,420,347 B2
(45) Date of Patent: Aug. 23, 2022

(54) TRIMMER BLADE AND BODY HAIR CUTTING DEVICE

(71) Applicant: PANASONIC INTELLECTUAL PROPERTY MANAGEMENT CO., LTD., Osaka (JP)

(72) Inventors: Shigetoshi Sakon, Shiga (JP); Kazuhiro Morisugi, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 120 days.

(21) Appl. No.: 16/977,710

(22) PCT Filed: Feb. 14, 2019

(86) PCT No.: PCT/JP2019/005253
§ 371 (c)(1),
(2) Date: Sep. 2, 2020

(87) PCT Pub. No.: WO2019/181295
PCT Pub. Date: Sep. 26, 2019

(65) Prior Publication Data

US 2021/0039271 A1 Feb. 11, 2021

(30) Foreign Application Priority Data

Mar. 20, 2018 (JP) ..... JP2018-051958

(51) Int. Cl.
*B26B 19/06* (2006.01)
*B26B 19/38* (2006.01)

(52) U.S. Cl.
CPC ..... *B26B 19/063* (2013.01); *B26B 19/3846* (2013.01)

(58) Field of Classification Search
None
See application file for complete search history.

(56) References Cited

U.S. PATENT DOCUMENTS 1,596,241 A * 8/1926 Donnellon ..... B26B 19/066 30/223
2,217,760 A * 10/1940 Martin ..... B26B 19/06 30/43.2

(Continued)

FOREIGN PATENT DOCUMENTS

CN 1833831 A 9/2006
DE 684916 C1 12/1939

(Continued)

OTHER PUBLICATIONS

International Search Report and Written Opinion issued in International Patent Application No. PCT/JP2019/005253, dated May 7, 2019; with partial English translation.

(Continued)

*Primary Examiner* — Hwei-Siu C Payer
(74) *Attorney, Agent, or Firm* — McDermott Will & Emery LLP

(57) ABSTRACT

Trimmer blade includes stationary blade that includes a plurality of first unit blades, and movable blade that includes a plurality of second unit blades and slides relative to stationary blade. A leading end of first unit blade includes projection that projects from first sliding surface of first unit blade. A leading end face of one of the plurality of second unit blades touches projection.

6 Claims, 15 Drawing Sheets

(56) References Cited

U.S. PATENT DOCUMENTS

| | | | | |
|---|---|---|---|---|
| 2,222,106 | A | 11/1940 | Raymond | |
| 2,233,446 | A | 3/1941 | Mathew | |
| 2,370,544 | A * | 2/1945 | Jepson | B26B 19/12 30/346.51 |
| 3,100,342 | A * | 8/1963 | Konig | B26B 19/06 30/200 |
| 9,156,173 | B2 * | 10/2015 | Fuerst | B26B 19/06 |
| 10,647,010 | B2 * | 5/2020 | Sablatschan | B26B 19/3893 |
| 2006/0207100 | A1 | 9/2006 | Shimizu | |
| 2014/0102271 | A1 * | 4/2014 | Krenik | B26B 19/388 83/13 |
| 2021/0039271 | A1 * | 2/2021 | Sakon | B26B 19/06 |

FOREIGN PATENT DOCUMENTS

| | | | |
|---|---|---|---|
| DE | 1114117 | B | 9/1961 |
| FR | 912112 | A | 7/1946 |
| JP | 50-155353 | A | 12/1975 |
| JP | 2006-255260 | A | 9/2006 |
| JP | 2014-033854 | A | 2/2014 |

OTHER PUBLICATIONS

English Translation of Chinese Search Report dated Jun. 24, 2021 for the related Chinese Patent Application No. 201980020112.4.
The Extended European Search Report dated Mar. 19, 2021 for the related European Patent Application No. 19771200.3.

* cited by examiner

TRIMMER BLADE AND BODY HAIR CUTTING DEVICE

CROSS-REFERENCE OF RELATED APPLICATIONS

This application is the U.S. National Phase under 35 U.S.C. § 371 of International Patent Application No. PCT/JP2019/005253, filed on Feb. 14, 2019, which in turn claims the benefit of Japanese Application No. 2018-051958, filed on Mar. 20, 2018, the entire disclosures of which Applications are incorporated by reference herein.

TECHNICAL FIELD

The present disclosure relates to a trimmer blade including a stationary blade and a movable blade and also relates to a body hair cutting device equipped with the trimmer blade, such as a hair trimmer, an electric hair clipper, or an electric razor.

BACKGROUND ART

A movable blade of a conventional trimmer blade has a cutting edge disposed at a deep position compared with a cutting edge of a stationary blade in order to be prevented from interfering with skin (refer to, for example, PTL 1).

CITATION LIST

Patent Literature

PTL 1: Unexamined Japanese Patent Publication No. 2014-33854

SUMMARY

With such structure, it is difficult to cut hair short. Hair cannot be cut short particularly when the stationary blade gradually increases in thickness from its cutting edge because a haircut position becomes where the stationary blade has an increased thickness as the cutting edge of the movable blade is more deeply located.

An object of the present disclosure is to provide a trimmer blade that is capable of preventing a movable blade from interfering with skin and is capable of cutting hair shorter.

To achieve the above object, a trimmer blade according to an aspect of the present disclosure includes a stationary blade that includes a plurality of first unit blades, and a movable blade that includes a plurality of second unit blades and slides relative to the stationary blade. A leading end of one of the plurality of first unit blades includes a projection that projects from a first sliding surface of the one of the plurality of first unit blades. A leading end face of one of the plurality of second unit blades touches the projection.

A body hair cutting device according an aspect of the present disclosure includes the above trimmer blade.

The trimmer blade and the body hair cutting device according to the present disclosure each are capable of preventing the movable blade from interfering with skin and are capable of cutting hair shorter.

DESCRIPTION OF EMBODIMENT

A trimmer blade according to a first aspect of the present disclosure includes a stationary blade that includes a plurality of first unit blades, and a movable blade that includes a plurality of second unit blades and slides relative to the stationary blade. A leading end of one of the plurality of first unit blades includes a projection that projects from a first sliding surface of the one of the plurality of first unit blades. A leading end face of one of the plurality of second unit blades touches the projection.

While being based on the first aspect, a trimmer blade according to a second aspect of the present disclosure is such that the leading end face of each of at least two second unit blades of the plurality of second unit blades touches the projection of a corresponding one of at least two first unit blades of the plurality of first unit blades.

While being based on the first aspect, a trimmer blade according to a third aspect of the present disclosure is as follows. The projection includes a counterface of planar shape that faces the leading end face of the one of the plurality of second unit blades, and the counterface includes a cutting edge along an edge of the counterface. The leading end face of the one of the plurality of second unit blades is of planar shape and includes a cutting edge along an edge of the leading end face.

While being based on the first aspect, a trimmer blade according to a fourth aspect of the present disclosure includes at least one of a groove along a boundary between the first sliding surface and the projection or a cut corner along a boundary between the leading end face and a second sliding surface of the one of the plurality of second unit blades that overlaps the first sliding surface.

While being based on the first aspect, a trimmer blade according to a fifth aspect of the present disclosure includes a bias part applying bias force to the movable blade toward the projection of the one of the plurality of first unit blades.

While being based on the first aspect, a trimmer blade according to a sixth aspect of the present disclosure is such that a corner defined by the leading end face of the one of the plurality of second unit blades and a lateral surface that connects with the leading end face has one of a chamfer and a radiused surface.

A body hair cutting device according to a seventh aspect of the present disclosure includes the trimmer blade according to the first aspect.

With reference to the drawings, a description is hereinafter provided of a trimmer blade according to an exemplary embodiment of the present disclosure.

[Overall Structure of Trimmer]

Figure 1:
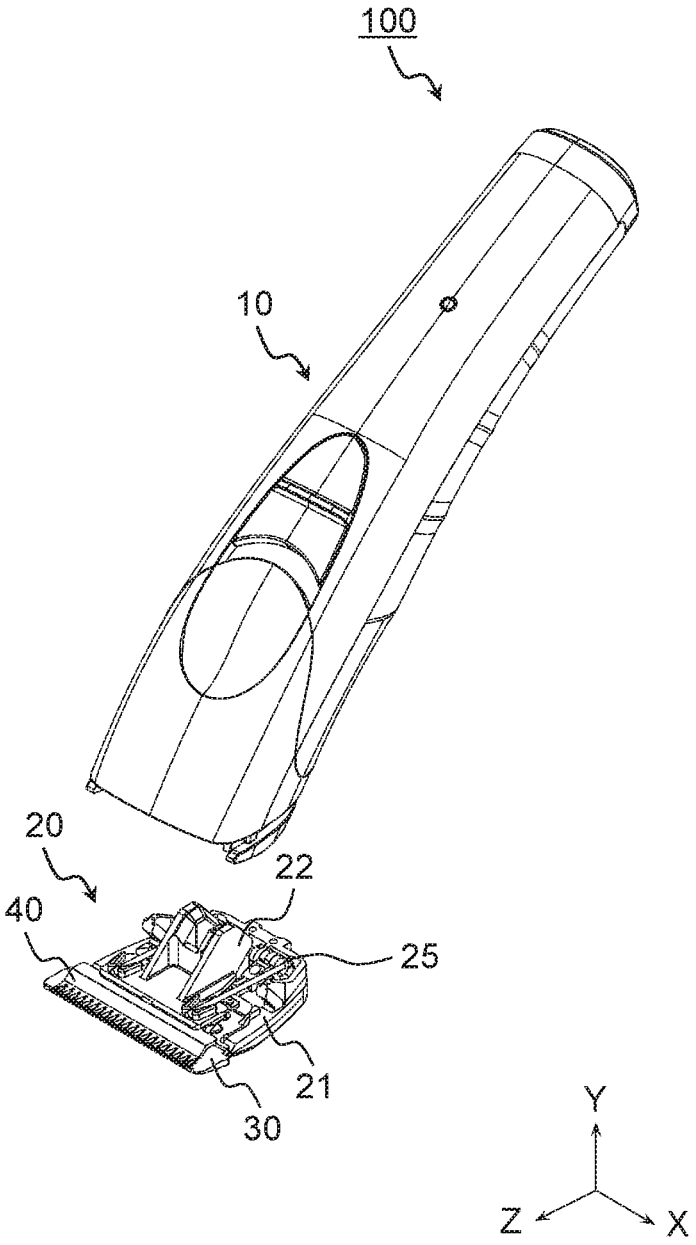
FIG. 1 is a perspective view schematically illustrating structure of a trimmer according to an exemplary embodiment.

A description is provided of overall structure of trimmer 100 according to the present exemplary embodiment first. FIG. 1 is a perspective view schematically illustrating the structure of trimmer 100. Trimmer 100 is an example of a body hair cutting device. As illustrated in FIG. 1, trimmer 100 is a hair trimmer including device body 10 that is configured to be held by a user, and trimmer blade 20 attached to device body 10. Device body 10 houses a drive unit (not illustrated) configured to drive movable blade 40 of trimmer blade 20, and a power supply unit (not illustrated) configured to electrically power the drive unit.

[Trimmer Blade]

Figure 2:
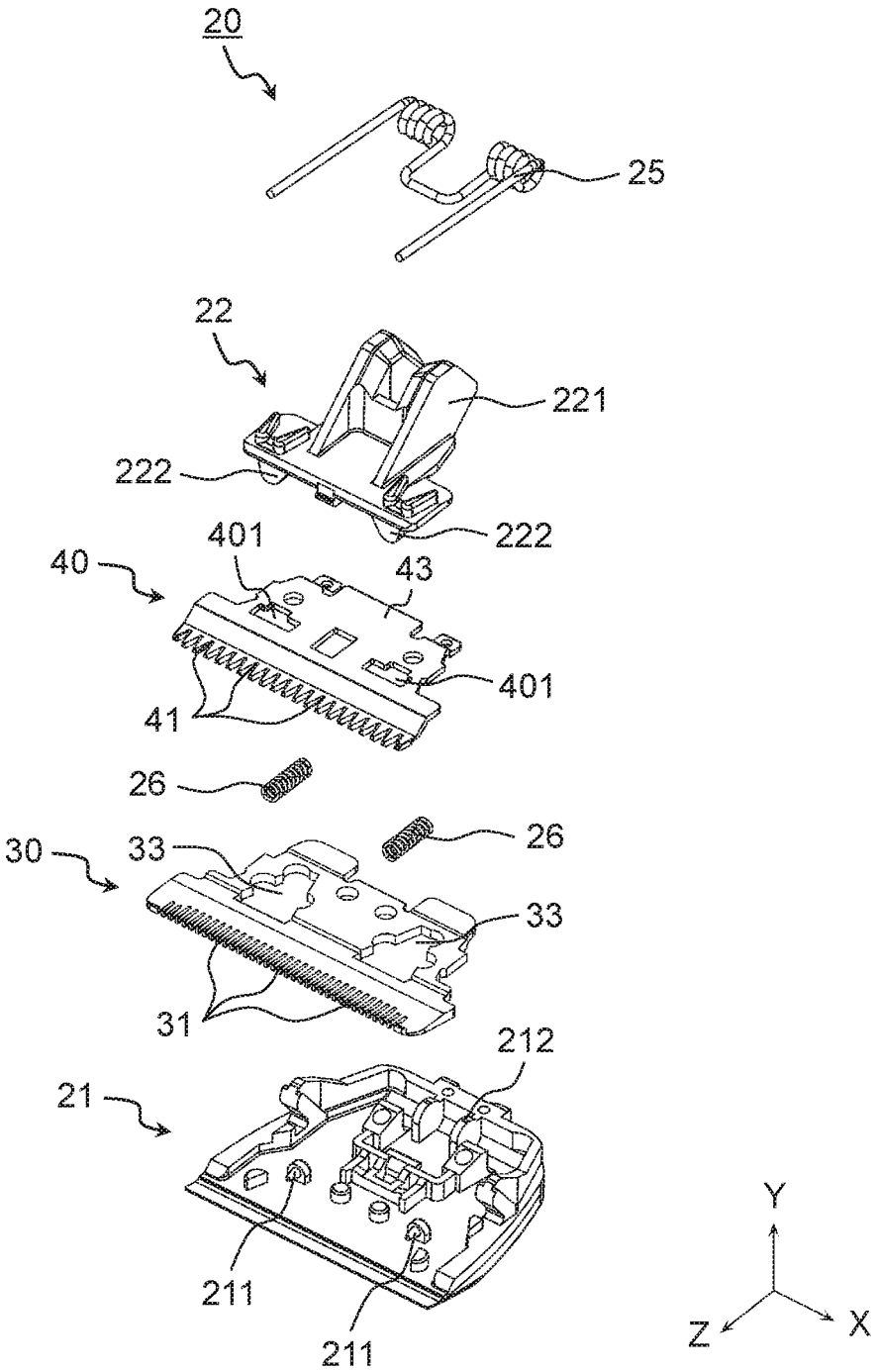
FIG. 2 is an exploded perspective view schematically illustrating structure of a trimmer blade according to the exemplary embodiment.
Figure 3:
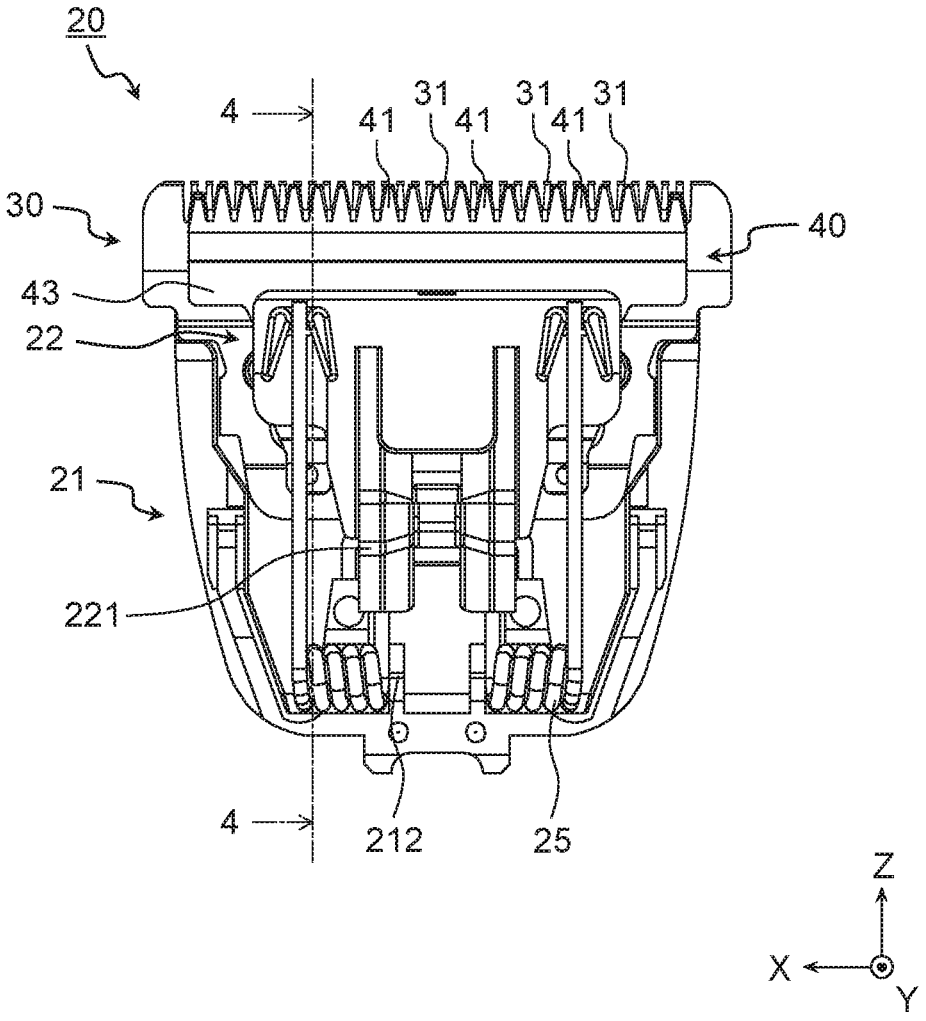
FIG. 3 is a plan view schematically illustrating the structure of the trimmer blade according to the exemplary embodiment.
Figure 4:
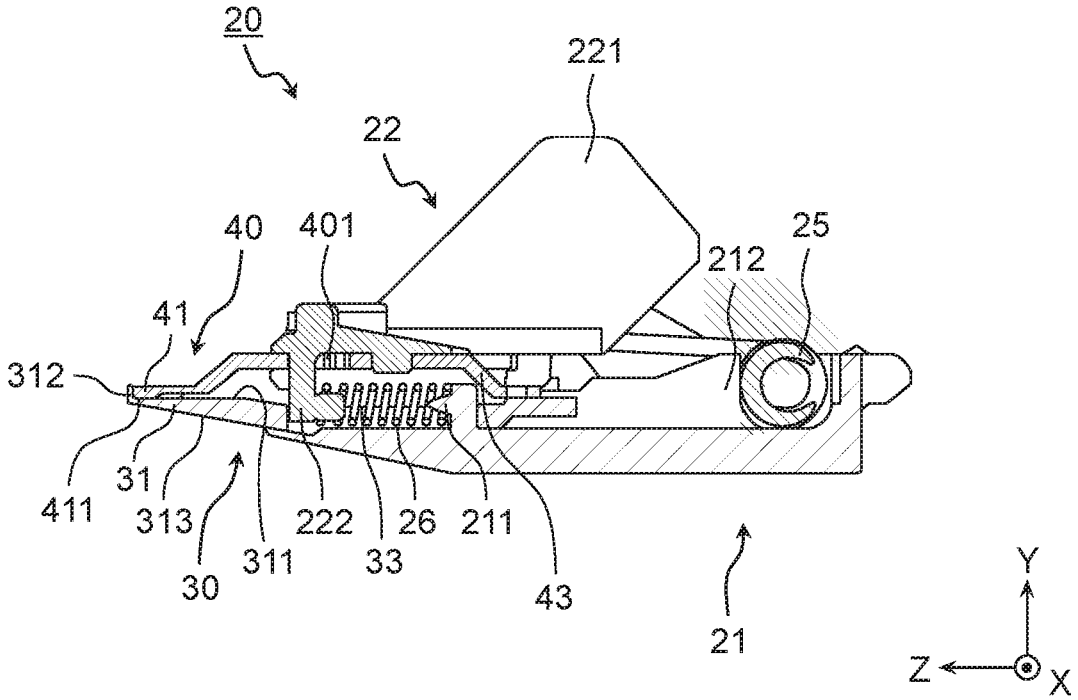
FIG. 4 is a sectional view schematically illustrating the structure of the trimmer blade according to the exemplary embodiment.

A detailed description is provided next of trimmer blade 20 according to the present exemplary embodiment. FIG. 2 is an exploded perspective view schematically illustrating structure of trimmer blade 20. FIG. 3 is a plan view schematically illustrating the structure of trimmer blade 20. FIG. 4 is a sectional view taken along line 4-4 of FIG. 3, schematically illustrating the structure of trimmer blade 20.

In the present disclosure, trimmer blade 20 has a width along an X-axis, stationary blade 30 and movable blade 40 have respective thicknesses along a Y-axis, and a Z-axis is orthogonal to the X- and Y-axes.

As illustrated in FIGS. 2 to 4, trimmer blade 20 includes stationary frame 21, stationary blade 30 fixed to a leading end of stationary frame 21, movable blade 40 that can reciprocate relative to stationary blade 30, and support frame 22 supporting movable blade 40.

Trimmer blade 20 includes first spring 25 and second springs 26. First spring 25 includes two connected torsion springs in order to bring movable blade 40 into contact with stationary blade 30. Second springs 26 are a pair of coil springs.

Stationary blade 30 includes a plurality of first unit blades 31. Stationary frame 21 holds stationary blade 30 with the plurality of first unit blades 31 projecting from stationary frame 21. Stationary blade 30 is fixed to stationary frame 21 so as not to shift. Stationary frame 21 is provided with a pair of locking pieces 211. One end of each of the pair of second springs 26 is locked to each of the pair of locking pieces 211. Stationary frame 21 is provided with a holder 212 that holds a midsection of first spring 25.

Movable blade 40 includes a plurality of second unit blades 41. Support frame 22 supports movable blade 40 with the plurality of second unit blades 41 projecting from support frame 22. Movable blade 40 is fixed to support frame 22 so as not to shift. Support frame 22 is disposed with the plurality of second unit blades 41 overlapping the plurality of first unit blades 31.

Support frame 22 is held by both ends of first spring 25 that is held by holder 212 of stationary frame 21. First spring 25 thus applies bias force to support frame 22 in a negative Y-axis direction. This means that this bias force also acts on movable blade 40. The bias force of first spring 25 is referred to as "first bias force".

Support frame 22 is held by another end of each second spring 26 locked to locking piece 211 of stationary frame 21. Each second spring 26 thus applies bias force to support frame 22 in a positive Z-axis direction. This means that this bias force also acts on movable blade 40. The bias force of each second spring 26 is referred to as "second bias force".

Support frame 22 includes connecting part 221 that is connected to a part of the drive unit when trimmer blade 20 is attached to device body 10. When the drive unit is activated, force along the width of trimmer blade 20 (along the X-axis) is transmitted to connecting part 221. Therefore, support frame 22 and movable blade 40 reciprocate along the width of trimmer blade 20.

Stationary blade 30 includes the plurality of first unit blades 31. The plurality of first unit blades 31 are evenly spaced along the width of trimmer blade 20. Slit 32 (refer to FIG. 5) is provided between adjacent two first unit blades 31.

Stationary blade 30 includes two openings 33, each of which receives a respective one of the pair of second springs 26. As illustrated in FIG. 4, each opening 33 also receives a part of support frame 22. That part of support frame 22 is locking part 222 to which the other end of second spring 26 is locked. Each of locking parts 222 projects downward from a bottom end face of support frame 22 and is passed through opening 401 provided in base 43 of movable blade 40. In this condition, each of locking parts 222 faces a respective one of locking pieces 211.

In other words, each second spring 26 is held between locking part 222 of support frame 22 and locking piece 211 of stationary frame 21 and extends along the Z-axis in opening 33. In this condition, each second spring 26 applies the second bias force to movable blade 40 via support frame 22.

As illustrated in FIGS. 2 to 4, movable blade 40 includes plate-shaped base 43 and the plurality of second unit blades 41 projecting from base 43. The plurality of second unit blades 41 are evenly spaced in the same direction as first unit blades 31. Slit 42 (refer to FIG. 5) is provided between adjacent two second unit blades 41. A pitch of the plurality of second unit blades 41 is different from a pitch of the plurality of first unit blades 31.

Movable blade 40 is pressed against stationary blade 30 by the first bias force of first spring 25. Therefore, while touching stationary blade 30, movable blade 40 reciprocates along the width of trimmer blade 20 together with support frame 22.

Figure 5:
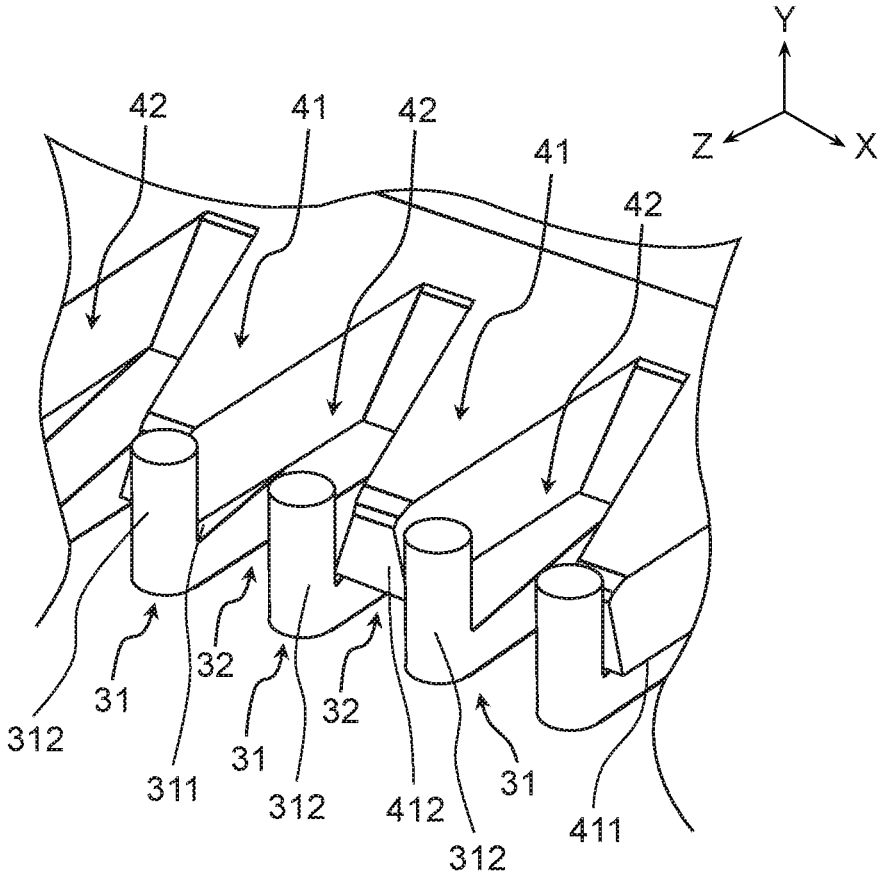
FIG. 5 is an enlarged perspective view illustrating first unit blades and second unit blades according to the exemplary embodiment.

A detailed description is provided next of first unit blade 31 of stationary blade 30 and second unit blade 41 of movable blade 40. FIG. 5 is an enlarged perspective view illustrating first unit blades 31 and second unit blades 41.

Figure 6:
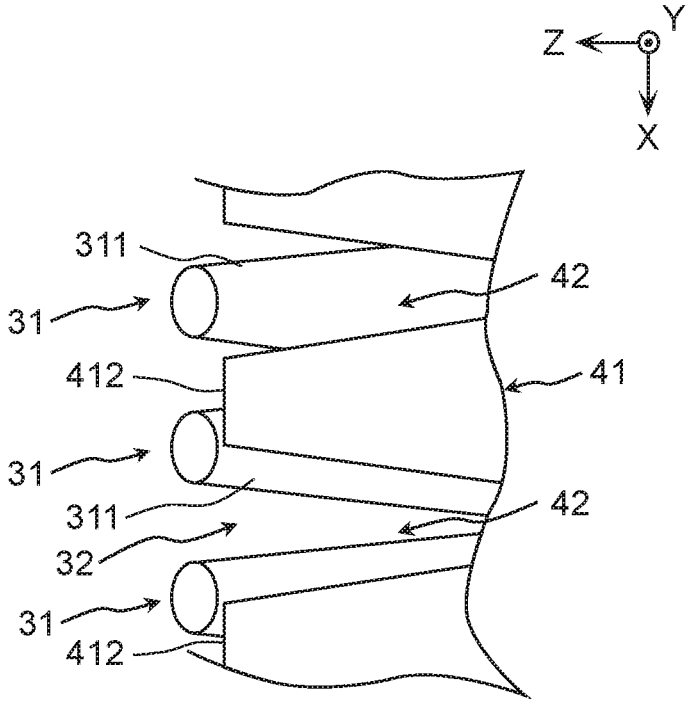
FIG. 6 is an enlarged plan view illustrating the first unit blades and the second unit blades according to the exemplary embodiment.
Figure 7:
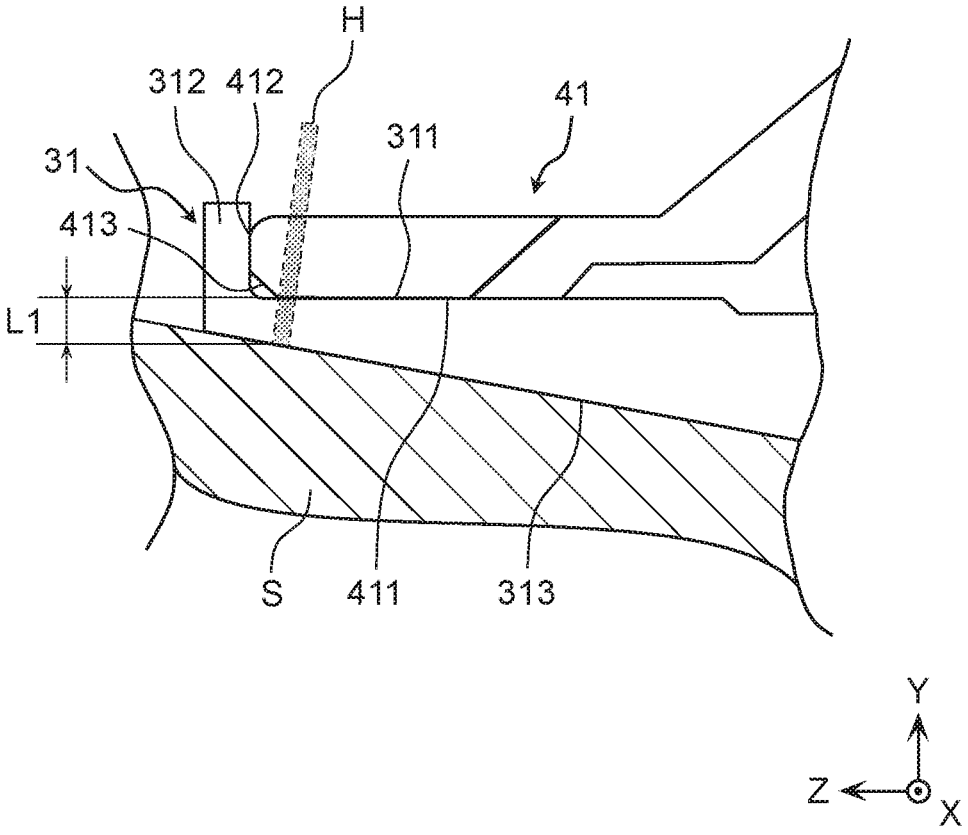
FIG. 7 is a side view schematically illustrating the first and second unit blades according to the exemplary embodiment that are being pressed against skin.

FIG. 6 is an enlarged plan view illustrating first unit blades 31 and second unit blades 41. FIG. 7 is aside view schematically illustrating first and second unit blades 31 and 41 being pressed against skin S.

While the following description is focused on one first unit blade 31 and one second unit blade 41, first unit blades 31 are identical in shape, and second unit blades 41 are identical in shape.

As illustrated in FIGS. 5 to 7, first sliding surface 311 is a second-unit-blade-end surface of first unit blade 31. Second unit blade 41 slides on first sliding surface 311. First sliding surface 311 is of planar shape and includes a cutting edge along its edge. The cutting edge of first sliding surface 311 is provided along slit 32.

A leading end of first unit blade 31 is provided with projection 312 that projects from first sliding surface 311 of first unit blade 31. Projection 312 has the shape of, for example, an elliptic cylinder having an axis along the Y-axis. In the present exemplary embodiment, stationary blade 30 is a metal integral member including projections 312. Stationary blade 30 may be an insert-molded member such that only projections 312 are made of resin, while the other portion is made of metal.

Projection 312 may have the shape of, for example, a circular cylinder or an oval cylinder. By being formed to have such a shape, projection 312 has a smooth curved surface that touches skin S. Accordingly, a burden on skin S can be smaller. Projection 312 may be orthogonal or inclined to first sliding surface 311.

Inclined surface 313 is a surface of first unit blade 31 that is positioned opposite second unit blade 41. Inclined surface 313 is inclined relative to first sliding surface 311, so that first unit blade 31 decreases in thickness toward its leading end.

Second sliding surface 411 is a first-unit-blade-end surface of second unit blade 41 and overlaps first sliding surface 311. Second sliding surface 411 is of planar shape to slide smoothly on first sliding surface 311 and includes a cutting edge along its edge. The cutting edge of second sliding surface 411 is provided along slit 42.

Leading end face 412 of second unit blade 41 is of planar shape. Second unit blade 41 includes cut corner 413 along a boundary between second sliding surface 411 and leading end face 412. Cut corner 413 may be a plane or a curved surface. If cut corner 413 is planar, cut corner 413 has a chamfer. If cut corner 413 is curved, cut corner 413 has a radiused surface.

There is a possibility that a limitation in terms of processing causes a rounded corner which is defined by projection 312 and first sliding surface 311 when first sliding surface 311 is provided with projection 312 at its leading end. Even when the corner is rounded, cut corner 413 of second unit blade 41 can form a space near that corner defined by first sliding surface 311 and projection 312. Therefore, second unit blade 41 does not easily interfere with that corner.

The pitch of the plurality of second unit blades 41 and the pitch of the plurality of first unit blades 31 are determined so that leading end face 412 of at least one of the plurality of second unit blades 41 touches projection 312 of any of the plurality of first unit blades 31 during reciprocation and stopping of movable blade 40.

Each second spring 26 is a bias part applying the second bias force to movable blade 40 toward projection 312 of first unit blade 31. With movable blade 40 experiencing the second bias force, leading end face 412 of the at least one of the plurality of second unit blades 41 touches projection 312 of the any of the plurality of first unit blades 31. Therefore, movable blade 40 does not advance any further.

Movable blade 40 always experiences the bias force that is directed toward projection 312. For this reason, leading end face 412 of the at least one of the plurality of second unit blades 41 continuously touches projection 312 of the any of the plurality of first unit blades 31 during reciprocation of movable blade 40. Thus stationary blade 30 and movable blade 40 do not easily shift relatively to each other along the Z-axis during reciprocation.

For increased stability during reciprocation, the pitch of the plurality of second unit blades 41 and the pitch of the plurality of first unit blades 31 may be determined so that leading end face 412 of each of at least two of the plurality of second unit blades 41 touches projection 312 of a corresponding one of at least two of the plurality of first unit blades 31.

A detailed description is provided next of relative positions of first unit blade 31 and second unit blade 41 when hair H is cut.

As illustrated in FIG. 7, stationary blade 30 is pressed against skin S when cutting hair H. Here skin S touches at least one of inclined surface 313 or projection 312.

Hair H that has entered slit 32 of stationary blade 30 and slit 42 of movable blade 40 is cut by the cutting edge of first sliding surface 311 and the cutting edge of second sliding surface 411 as movable blade 40 reciprocates. Consequently, hair H has length L1 as illustrated in FIG. 7.

Figure 11:
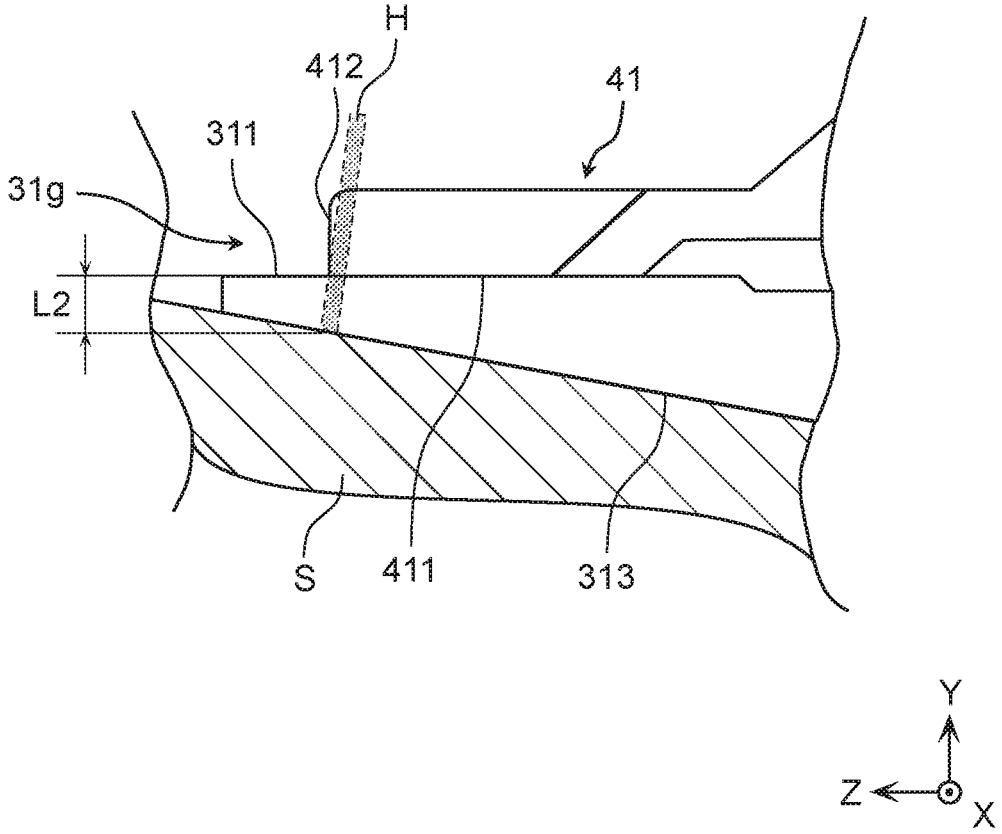
FIG. 11 is a side view schematically illustrating the first and second unit blades according to the comparative example that are being pressed against skin.

After cutting with a conventional trimmer blade, hair H has length L2 (refer to FIG. 11). Length L1 is shorter than length L2 if trimmer blade 20 of the present exemplary embodiment and the conventional trimmer blade have identical design elements (including, for example, a width of first unit blade 31, a width of slit 32, and the pitch), except projection 312. A reason for that is explained below.

Figure 8:
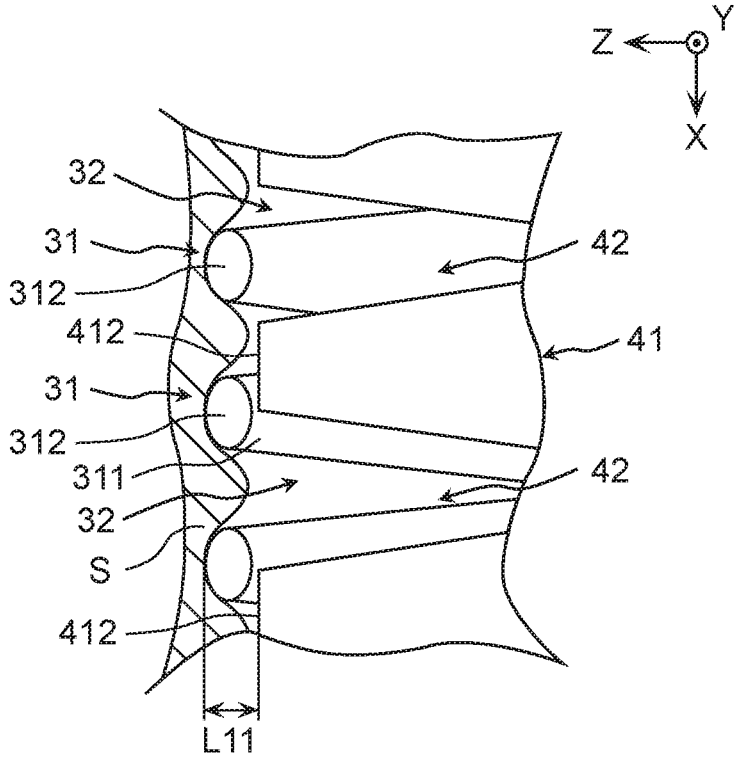
FIG. 8 is a plan view illustrating skin touching respective projections of the first unit blades according to the exemplary embodiment.

FIG. 8 is a plan view illustrating skin S touching respective projections 312 of first unit blades 31. As illustrated in FIG. 8, providing projection 312 at the leading end of first unit blade 31 increases an area of contact between first unit blade 31 and skin S compared with when no projection 312 is provided. This enables skin S to experience reduced contact pressure, so that skin S does not easily enter slit 32 of stationary blade 30 along the Z-axis. Therefore, leading end face 412 of second unit blade 41 can be disposed in contiguity with projection 312 of first unit blade 31 to touch projection 312.

Comparative Example

A description is provided next of first unit blade 31*g* of the conventional trimmer blade given as a comparative example. Structurally, first unit blade 31*g* according to the comparative example is first unit blade 31 of the above exemplary embodiment minus projection 312. In the description of the comparative example, parts identical to those of trimmer blade 20 according to the above exemplary embodiment have the same reference marks and may not be described.

Figure 9:
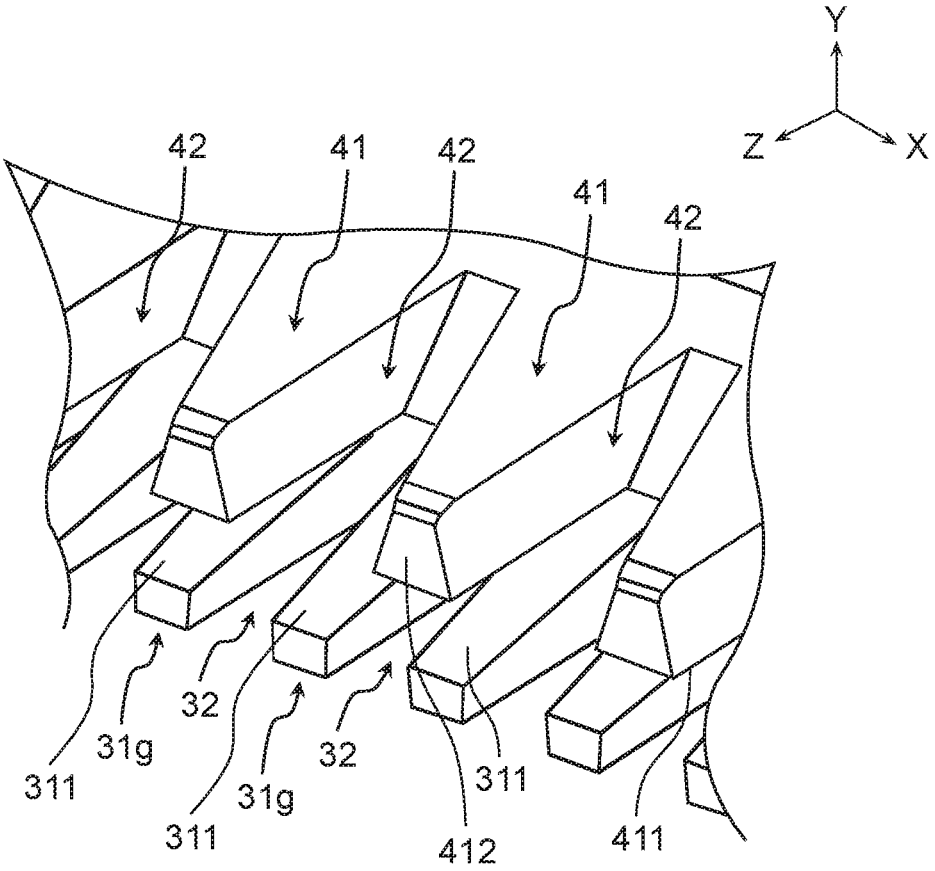
FIG. 9 is an enlarged perspective view illustrating first unit blades and second unit blades according to a comparative example.
Figure 10:
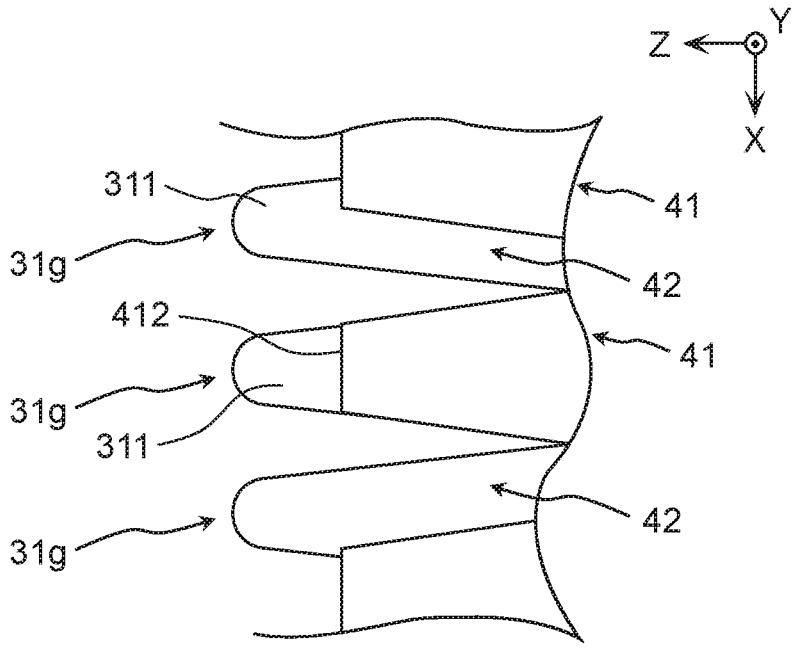
FIG. 10 is an enlarged plan view illustrating the first unit blades and the second unit blades according to the comparative example.
Figure 12:
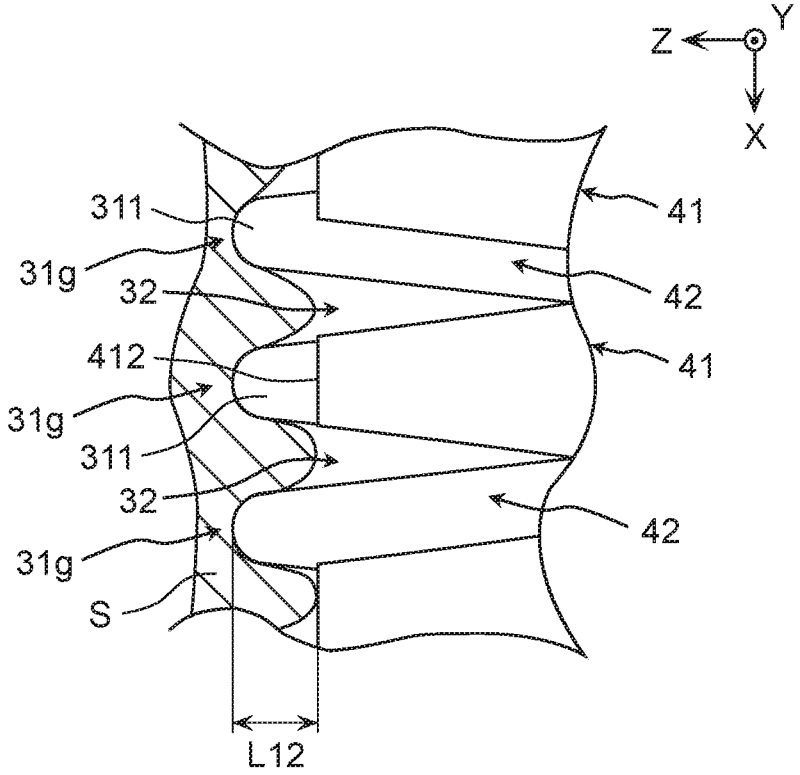
FIG. 12 is a plan view illustrating skin touching respective leading end faces of the first unit blades according to the comparative example.

FIG. 9 is an enlarged perspective view illustrating first unit blades 31*g* and second unit blades 41. FIG. 10 is an enlarged plan view illustrating first unit blades 31*g* and second unit blades 41. FIG. 11 is a side view schematically illustrating first and second unit blades 31*g* and 41 being pressed against skin S. FIG. 12 is a plan view illustrating skin S touching respective leading end faces of first unit blades 31*g*.

As illustrated in FIGS. 9 to 11, first unit blade 31*g* has no projection 312. For this reason, first unit blade 31*g* applies increased contact pressure to skin S compared with first unit blade 31 according to the exemplary embodiment. Therefore, as illustrated in FIG. 12, skin S easily enters slit 32 along the Z-axis. Consequently, skin S entering slit 32 reaches a deeper position. In that case, skin S comes into contact with second unit blade 41 and is easily damaged.

In order for the contact between second unit blade 41 and skin S to be avoided, leading end face 412 of second unit blade 41 is disposed away from a leading edge of first unit blade 31*g*. Distance L12 from leading end face 412 of second unit blade 41 to the leading edge of first unit blade 31*g* according to the comparative example is longer than distance L11 (refer to FIG. 8) from leading end face 412 of second unit blade 41 to a leading edge of first unit blade 31 according to the above exemplary embodiment.

In other words, leading end face 412 of second unit blade 41 according to the comparative example is disposed at a deeper position than leading end face 412 of second unit blade 41 according to the above exemplary embodiment. In the comparative example, remaining hair H of skin S therefore has length L2 that is longer than length L1 of that in the above exemplary embodiment. The above exemplary embodiment enables a short haircut compared with the comparative example.

[Effects and Others]

As described above, trimmer blade 20 according to the present exemplary embodiment includes stationary blade 30 that includes the plurality of first unit blades 31, and movable blade 40 that includes the plurality of second unit blades 41 and slides relative to stationary blade 30. The leading end of the one of the plurality of first unit blades 31 includes projection 312 that projects from first sliding surface 311. Leading end face 412 of the at least one of the plurality of second unit blades 41 touches projection 312.

In the present exemplary embodiment, the leading end of the one of the plurality of first unit blades 31 includes projection 312 that projects from first sliding surface 311. Therefore, projection 312 can touch skin S. As a result, stationary blade 30 as a whole can have an increased area of contact with skin S compared with when stationary blade 30 has no projection 312. The increased area of contact can effect reduced contact pressure on skin S, so that skin S does not easily enter slit 32 of stationary blade 30.

Leading end face 412 of the at least one of the plurality of second unit blades 41 touches projection 312. Therefore, leading end face 412 of second unit blade 41 does not easily touch skin S. Moreover, the plurality of second unit blades 41 can be as close as possible to those respective leading edges of the plurality of first unit blades 31.

The present exemplary embodiment described above can prevent movable blade 40 from interfering with skin S and enables a shorter haircut.

Since leading end face 412 of each of the at least two of the plurality of second unit blades 41 touches projections 312 of a corresponding one of the at least two of the plurality of first unit blades 31, movable blade 40 is particularly enabled to reciprocate stably.

Trimmer blade 20 includes cut corner 413 along the boundary between leading end face 412 and second sliding surface 411 that overlaps first sliding surface 311. Cut corner 413 can form the space near the corner defined by first sliding surface 311 and projection 312. Consequently, second unit blade 41 can be prevented from interfering with the corner.

Trimmer blade 20 includes second springs (bias parts) 26 each applying the second bias force to movable blade 40 toward projection 312 of first unit blade 31. Projection 312 of first unit blade 31 thus can have a stable fit with leading end face 412 of second unit blade 41. This means that movable blade 40 can be prevented from shifting along the Z-axis and thus can cut hair stably.

[First Modification]

In the structure given as the example in the above exemplary embodiment, leading end face 412 of second unit blade 41 merely touches projection 312 of first unit blade 31. In a structure given as an example in a first modification, a cut can be made with a projection of a first unit blade and a leading end face of a second unit blade.

Figure 13:
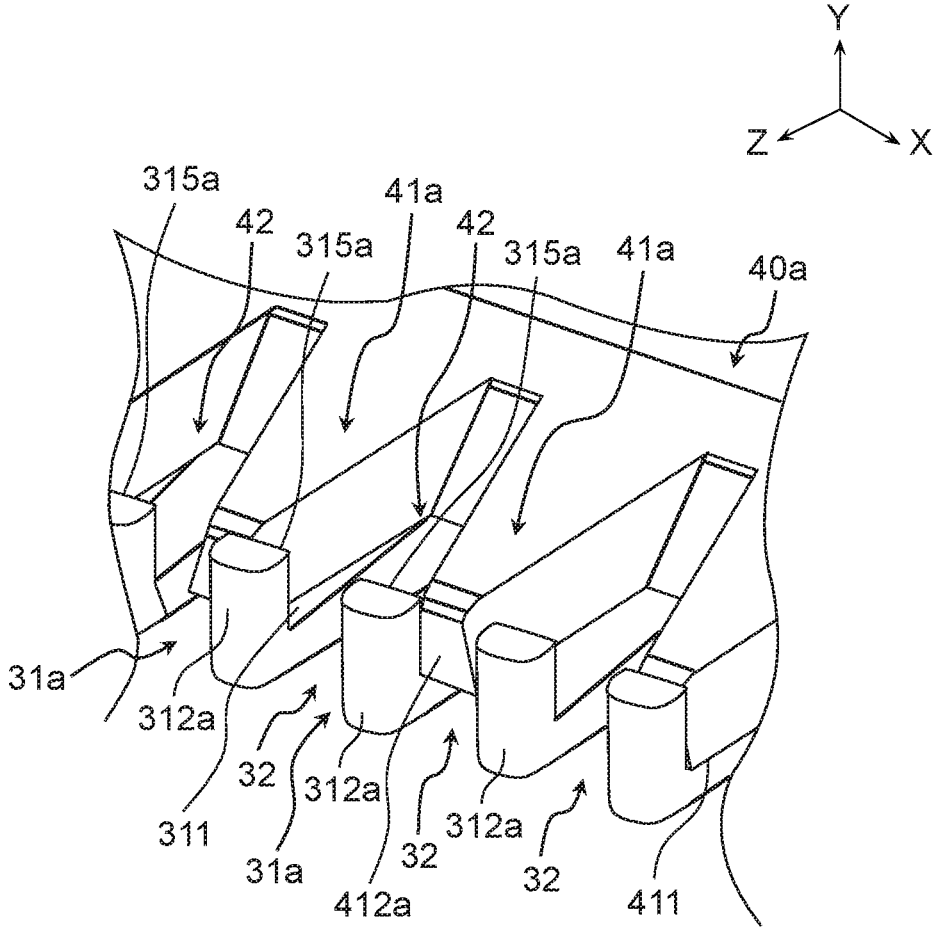
FIG. 13 is an enlarged perspective view illustrating first unit blades and second unit blades according to a first modification.
Figure 14:
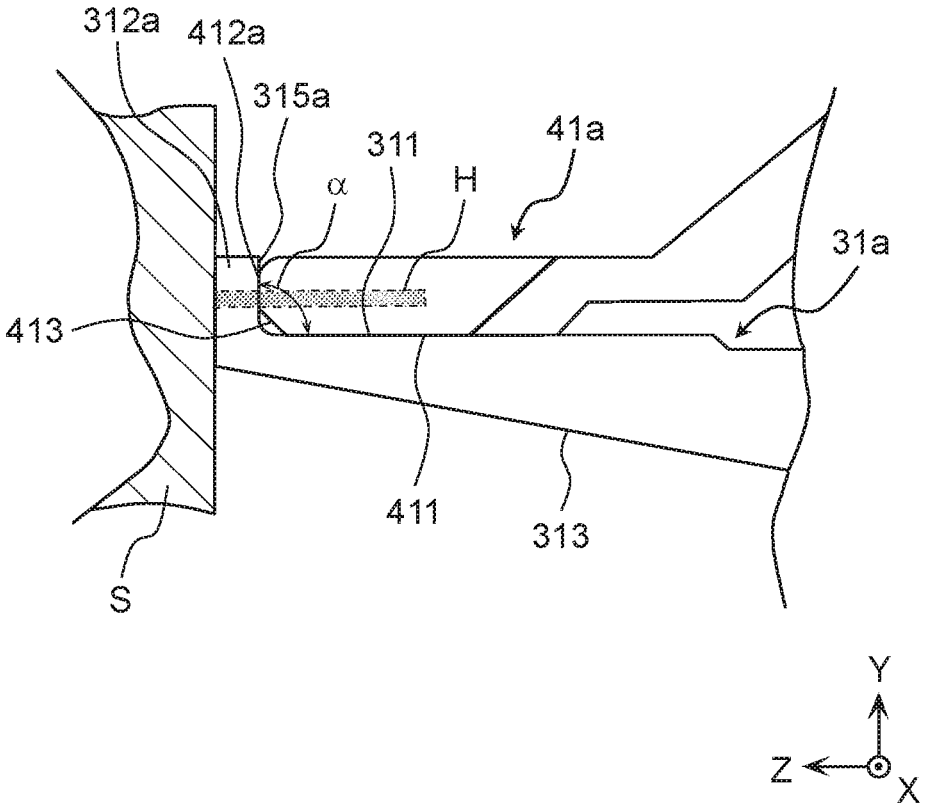
FIG. 14 is a side view schematically illustrating the first and second unit blades according to the first modification that are being pressed against skin.

FIG. 13 is an enlarged perspective view illustrating first unit blades 31*a* and second unit blades 41*a* according to the present modification. FIG. 14 is a side view schematically illustrating first and second unit blades 31*a* and 41*a* being pressed against skin S. Ina description below, parts identical to those in the above-described exemplary embodiment have the same reference marks and may not be described.

As illustrated in FIGS. 13 and 14, projection 312*a* of first unit blade 31*a* according to the present modification has the shape of a prismatic column having an axis along the Y-axis. Specifically, projection 312*a* is of trapezoidal shape when viewed along the Y-axis. Projection 312*a* has a lower base in a negative Z-axis direction and an upper base in a positive Z-axis direction.

Counterface 315*a* of projection 312*a* faces leading end face 412*a* of second unit blade 41*a*. Counterface 315*a* is of planar shape and includes a cutting edge along its edge. The cutting edge of counterface 315*a* is provided along each of those edges that face each other across a width of counterface 315*a* (along the X-axis).

Leading end face 412*a* of second unit blade 41*a* is of planar shape and includes a cutting edge along its edge. The cutting edge of leading end face 412*a* is provided along each of those edges that face each other across a width of leading end face 412*a* (along the X-axis).

Hair H enters slits 32, 42 from in front of first unit blade 31*a*. Hair H is cut by the cutting edge of counterface 315*a* and the cutting edge of leading end face 412*a* as movable blade 40*a* reciprocates.

A corner defined by counterface 315*a* and first sliding surface 311 of first unit blade 31*a* has the same angle (angle $\alpha$) as a corner defined by leading end face 412*a* and second sliding surface 411 of second unit blade 41*a*. Angle $\alpha$ ranges between 45 degrees and 135 degrees, inclusive. Angle $\alpha$ in this range enables a stable haircut.

In the present modification, counterface 315*a* of first unit blade 31*a* is of planar shape and includes the cutting edge along its edge, and leading end face 412*a* of second unit blade 41*a* is of planar shape and includes the cutting edge along its edge.

The present modification enables not only the cutting edges of first and second sliding surfaces 311 and 411 but also the cutting edges of counterface 315*a* and leading end face 412*a* to cut hair H. This means that projection 312*a* includes the cutting edge that can cut hair H when projection 312*a* is pressed against skin S. Therefore, hair H of a part that is intended by a user can be cut with ease.

Decreasing a Z-axis thickness of projection 312*a* enables the cutting edge of counterface 315*a* and the cutting edge of leading end face 412*a* to provide an even shorter haircut.

Providing movable blade 40*a* with cut corners 413 can prevent second unit blade 41*a* from interfering with the corner defined by first sliding surface 311 and projection

312*a* of first unit blade 31*a* as in the above description. Counterface 315*a* of first unit blade 31*a* can, therefore, have a stable fit with leading end face 412*a* of second unit blade 41*a*. This means that the cutting edge of counterface 315*a* and the cutting edge of leading end face 412*a* can cut hair H stably.

Applying the second bias force to movable blade 40*a* by means of second spring 26 also enables counterface 315*a* of first unit blade 31*a* to have the stable fit with leading end face 412*a* of second unit blade 41*a* as in the above description. Consequently, the cutting edge of counterface 315*a* and the cutting edge of leading end face 412*a* can cut hair H stably.

[Second Modification]

In the structure given as the example in the above exemplary embodiment, movable blade 40 is provided with cut corners 413 in order to prevent interference between first unit blade 31 and second unit blade 41. In a structure given as an example in a second modification, a stationary blade is provided with grooves to prevent interference between a first unit blade and a second unit blade.

Figure 15:
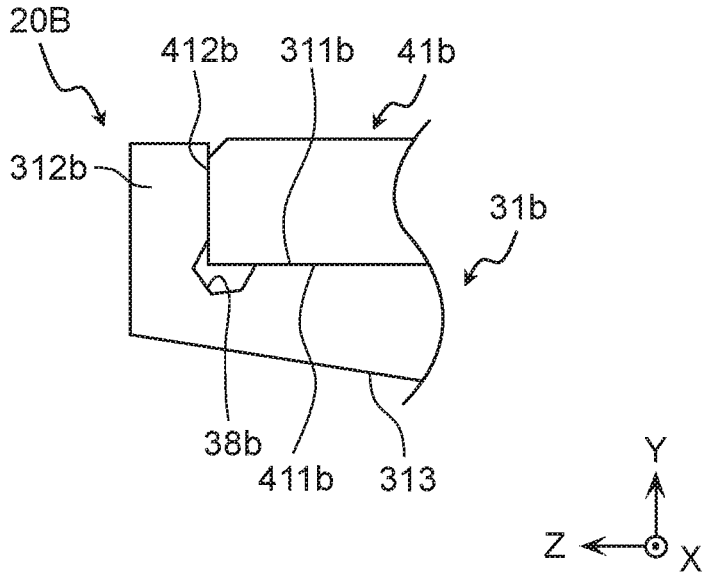
FIG. 15 is an enlarged side view illustrating a first unit blade and a second unit blade according to a second modification.

FIG. 15 is an enlarged side view illustrating first unit blade 31*b* and second unit blade 41*b* according to the present modification. As illustrated in FIG. 15, trimmer blade 20B according to the present modification includes groove 38*b* along a boundary between first sliding surface 311*b* and projection 312*b* of first unit blade 31*b*.

Specifically, groove 38*b* is formed continuously along an entire width of first unit blade 31*b*. Second unit blade 41*b* does not have a cut corner but a corner that is defined by leading end face 412*b* and second sliding surface 411*b*. This corner is disposed in groove 38*b* when leading end face 412*b* of second unit blade 41*b* comes into contact with projection of 312*b* of first unit blade 31*b*. This corner, however, does not interfere with first unit blade 31*b*.

Trimmer blade 20B according to the present modification includes groove 38*b* along the boundary between first sliding surface 311*b* and projection 312*b*. Groove 38*b* defines a space along the boundary between first sliding surface 311*b* and projection 312*b*. Consequently, the corner defined by leading end face 412*b* and second sliding surface 411*b* can be prevented from interfering with first unit blade 31*b*.

The trimmer blade may include both a cut corner and a groove. In that case, interference between a movable blade and a stationary blade can be prevented more reliably.

[Third Modification]

In a third modification, a description is provided of shape of a corner defined by a leading end face of a second unit blade and a lateral surface that connects with the leading end face.

Figure 16:
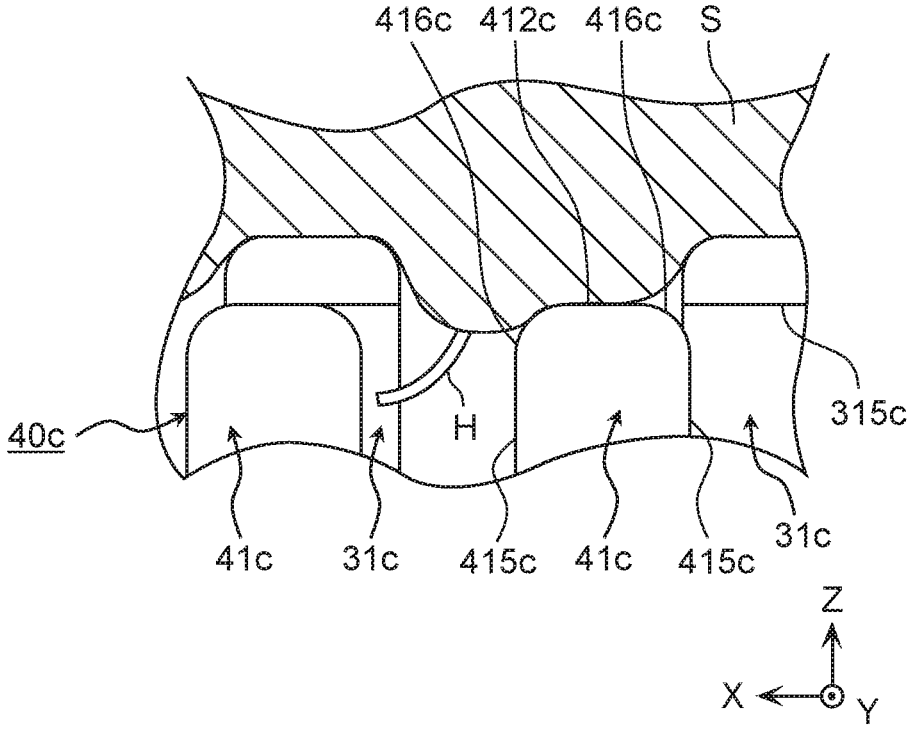
FIG. 16 is a plan view schematically illustrating first unit blades and second unit blades according to a third modification that are being pressed against skin.

FIG. 16 is a plan view schematically illustrating first unit blades 31*c* and second unit blades 41*c* according to the present modification that are being pressed against skin S. As illustrated in FIG. 16, corner 416*c* defined by leading end face 412*c* of second unit blade 41*c* and lateral surface 415*c* that connects with leading end face 412*c* is radiused by cutting. Specifically, corner 416*c* is shaped to have an outwardly curved surface that is convex.

Corner 416*c* may be shaped to have a flat surface as a result of cutting. If corner 416*c* is made by cutting, a burden on skin S can be reduced even when corner 416*c* touches skin S.

In FIG. 16, the shape of corner 416*c* is exaggeratedly illustrated. Actually, corner 416*c* has a curvature radius of about several tens of micrometers. With corner 416*c* having such a curvature radius, hair H can be cut by cooperation between counterface 315*c* of first unit blade 31*c* and leading end face 412*c* of second unit blade 41*c*. When corner 416*c* is shaped to have the flat surface by cutting, a cutting amount is, for example, about several tens of micrometers. Even in this case, hair H can be cut.

According to the present modification, corner 416*c* that is defined by leading end face 412*c* of second unit blade 41*c* and lateral surface 415*c* that connects with leading end face 412*c* is made by cutting. Movable blade 40*c* reciprocates at high speed, meaning that the burden on skin S increases. However, making corner 416*c* that is defined by leading end face 412*c* and lateral surface 415*c* by cutting can reduce the burden on skin S, so that skin S is not easily damaged.

INDUSTRIAL APPLICABILITY

The present disclosure is applicable to a trimmer blade provided to a body hair cutting device such as a trimmer.

REFERENCE MARKS IN THE DRAWINGS

10: device body
20, 20B: trimmer blade
21: stationary frame
22: support frame
25: first spring
26: second spring
30: stationary blade
31, 31*a*, 31*b*. 31*c*: first unit blade
32, 42: slit
33, 401: opening
38*b*: groove
40, 40*a*, 40*c*: movable blade
41, 41*a*, 41*b*, 41*c*: second unit blade
43: base
100: trimmer
211: locking piece
212: holder
221: connecting part
222: locking part
311, 311*b*: first sliding surface
312, 312*a*, 312*b*: projection
313: inclined surface
315*a*, 315*c*: counterface
411, 411*b*: second sliding surface
412, 412*a*, 412*b*, 412*c*: leading end face
413: cut corner
415*c*: lateral surface
416*c*: corner

The invention claimed is:

1. A trimmer blade comprising:

a stationary blade including a plurality of first unit blades; and a movable blade that includes a plurality of second unit blades and slides relative to the stationary blade, wherein:

a leading end of one of the plurality of first unit blades includes a projection projecting from a first sliding surface of the one of the plurality of first unit blades, a leading end face of one of the plurality of second unit blades touches the projection, and the trimmer blade further comprises at least one of a groove along a boundary between the first sliding surface and the projection or a cut corner along a boundary between the leading end face and a second sliding surface of the one of the plurality of second unit blades, the second sliding surface overlapping the first sliding surface.

2. The trimmer blade according to claim 1, wherein the leading end face of each of at least two of second unit blades of the plurality of second unit blades touches the projection of a corresponding one of at least two first unit blades of the plurality of first unit blades.

3. The trimmer blade according to claim 1, wherein the projection includes a counterface of planar shape, the counterface facing the leading end face of the one of the plurality of second unit blades and including a cutting edge along an edge of the counterface, and the leading end face of the one of the plurality of second unit blades is of planar shape and includes a cutting edge along an edge of the leading end face.

4. The trimmer blade according to claim 1, further comprising a bias part applying bias force to the movable blade toward the projection of the one of the plurality of first unit blades.

5. The trimmer blade according to claim 1, wherein a corner defined by the leading end face of the one of the plurality of second unit blades and a lateral surface that connects with the leading end face has one of a chamfer and a radiused surface.

6. A body hair cutting device comprising:

a device body; and the trimmer blade according to claim 1 attached to the device body.

* * * * *